US007779654B2

(12) United States Patent
Garus

(10) Patent No.: US 7,779,654 B2
(45) Date of Patent: Aug. 24, 2010

(54) KNITTED SPACER FABRIC AND METHOD FOR THE PRODUCTION THEREOF

(75) Inventor: Bernard Garus, Einbeck (DE)

(73) Assignee: Otto Bock HealthCare IP GmbH & Co. KG, Duderstadt (DE)

( * ) Notice: Subject to any disclaimer, the term of this patent is extended or adjusted under 35 U.S.C. 154(b) by 0 days.

(21) Appl. No.: 12/162,625

(22) PCT Filed: Jan. 31, 2007

(86) PCT No.: PCT/DE2007/000187

§ 371 (c)(1),
(2), (4) Date: Jul. 30, 2008

(87) PCT Pub. No.: WO2007/087792

PCT Pub. Date: Aug. 9, 2007

(65) Prior Publication Data

US 2009/0049870 A1 Feb. 26, 2009

(30) Foreign Application Priority Data

Feb. 1, 2006 (DE) ..... 10 2006 004 914

(51) Int. Cl.
*D04B 7/04* (2006.01)

(52) U.S. Cl. ..... 66/195; 66/196

(58) Field of Classification Search ..... 66/195, 66/196, 202, 200, 193; 442/309, 310
See application file for complete search history.

(56) References Cited

U.S. PATENT DOCUMENTS

| | | | | |
|---|---|---|---|---|
| 459,866 | A * | 9/1891 | Clewley | 66/170 |
| 3,796,066 | A * | 3/1974 | Millar | 66/95 |
| 4,818,316 | A * | 4/1989 | Weinle et al. | 66/193 |
| 5,385,036 | A * | 1/1995 | Spillane et al. | 66/87 |
| 6,105,401 | A * | 8/2000 | Chadeyron et al. | 66/195 |
| 6,477,865 | B1 * | 11/2002 | Matsumoto | 66/195 |
| 6,564,590 | B2 * | 5/2003 | Matsuda | 66/193 |
| 6,588,237 | B2 * | 7/2003 | Cole et al. | 66/202 |
| 6,644,070 | B2 * | 11/2003 | Ikenaga et al. | 66/196 |
| 6,755,052 | B1 * | 6/2004 | Sytz | 66/196 |
| 6,779,369 | B2 * | 8/2004 | Shepherd | 66/196 |
| 7,418,837 | B2 * | 9/2008 | Muller et al. | 66/195 |
| 2002/0157429 | A1 * | 10/2002 | Matsumoto | 66/195 |
| 2009/0049870 | A1 * | 2/2009 | Garus | 66/192 |

FOREIGN PATENT DOCUMENTS

| | | |
|---|---|---|
| DE | 10201350 | 7/2003 |
| DE | 10251581 | 10/2003 |
| DE | 102005050405 | 4/2007 |
| EP | 0833000 | 1/1998 |
| WO | 2005052235 | 6/2005 |

OTHER PUBLICATIONS

International Search Report for PCT/DE2007/000187, mailed Feb. 18, 2008, 3 pages.

* cited by examiner

*Primary Examiner*—Danny Worrell
(74) *Attorney, Agent, or Firm*—Faegre & Benson LLP

(57) ABSTRACT

A knitted spacer fabric includes an upper textile, a lower textile and mutually crossing supporting threads arranged between the upper textile and the lower textile which connect the upper and the lower textiles to one another. Portions of the supporting threads are connected to one another at crossing points.

17 Claims, 1 Drawing Sheet

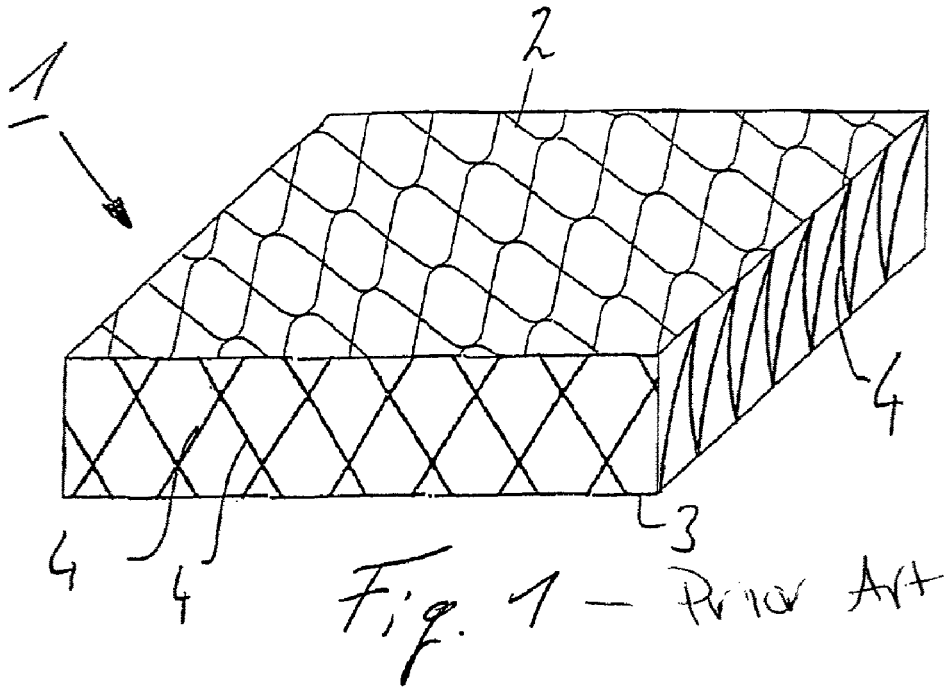
Fig. 1 – Prior Art
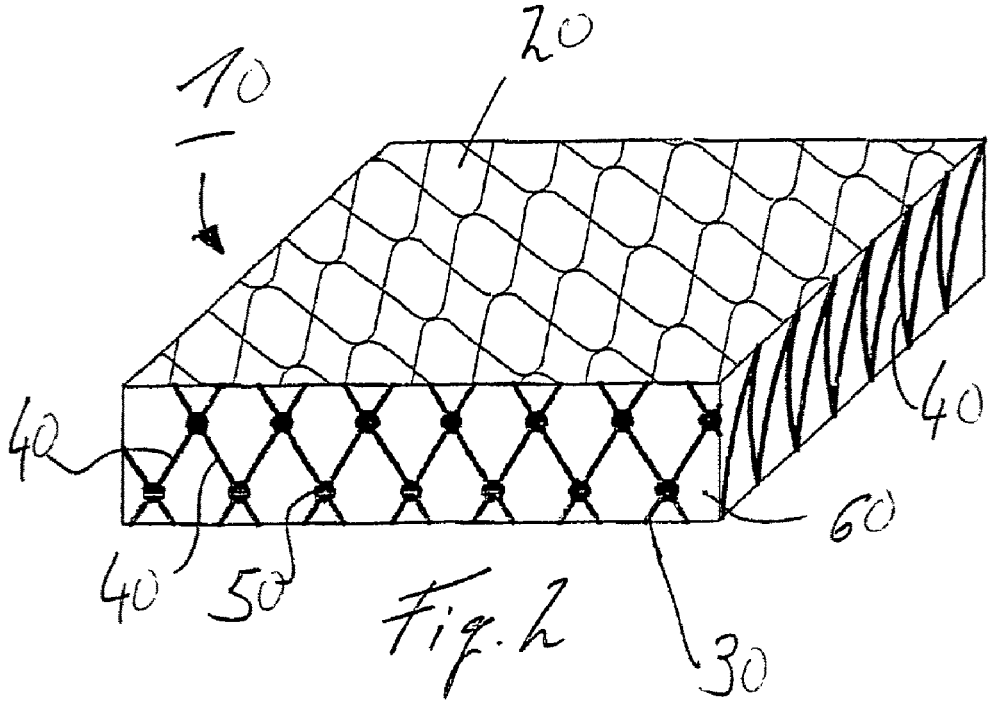
Fig. 2

KNITTED SPACER FABRIC AND METHOD FOR THE PRODUCTION THEREOF

CROSS-REFERENCE TO RELATED APPLICATION

This patent application is a national stage application of International Application No. PCT/DE2007/000187 filed Jan. 31, 2007, which claims priority to German Patent No. DE 10 2006 004 914.4, filed on Feb. 1, 2006. The entire content of these applications are hereby expressly incorporated by reference.

FIELD OF THE INVENTION

The invention relates to a knitted spacer fabric with an upper textile and with a lower textile, between which are arranged mutually crossing supporting threads which connect the upper and the lower textile to one another, and to a method for the production thereof.

Knitted spacer fabrics include an upper textile and a lower textile which are spaced apart from one another via supporting threads such as monofilaments. Supporting threads or monofilaments are synthetic materials and, as a rule, consist of a strand. The compressive hardness of the knitted spacer fabric is determined as a function of the diameter of the supporting threads, their bonding to the textiles, the density in the finished knitted spacer fabric and the crossing angle of the supporting threads with respect to one another. Knitted spacer fabrics are used, for example, as a sitting base for wheelchairs or as a sleeping base for decubitus patients. Conventional knitted spacer fabrics have the disadvantage that they can absorb shear forces to only a very limited extent, and that they are capable to only a limited extent of keeping the textiles spaced apart from one another.

SUMMARY OF THE INVENTION

The object of the present invention is to provide a knitted spacer fabric, and a method for the production thereof, having improved shear and compressive strength.

The knitted spacer fabric according to one embodiment of the present invention provides an upper and a lower textile, between which are arranged mutually crossing supporting threads which keep the upper and lower textiles spaced apart from and connected to one another. At least parts of the supporting threads are connected to one another at their crossing points, to provide the knitted fabric spacer with an increased shear strength increased compression resistance. In one embodiment, the finished knitted spacer fabric can not be pressed together completely, or at least only in response to an increased pressure force. Since the mutually crossing supporting or spacer threads are connected to one another at specific points, they function in a comparable way to welded wires in a wire mesh fence. The hardness of the knitted spacer fabric can be set as a function of the density and the crossing angle of the supporting threads and of the number and arrangement of the connections at the crossing points.

According to another embodiment of the invention, the supporting threads are formed as monofilaments, twisted supporting threads or spun core/sheath assemblies. In particular, the supporting threads, such as monofilament, spun core/sheath assemblies or twisted supporting threads, may be coated or sheathed to allow or facilitate the connection of a plurality of supporting threads to one another at their crossing points. The coating or sheathing may be formed of a synthetic material or of an adhesive which has a lower melting or activation temperature than the core of the supporting thread. As a result, a connection of a plurality of supporting threads to one another can be implemented by heating the ready-knitted spacer fabric without any loss of strength or any substantial variation in the geometric conditions.

In another embodiment, two mutually crossing supporting threads covered with a layer of synthetic material are connected in a materially integral manner by melting and fusing the outer coating, and the mutually crossing supporting threads then bear against one another or are continuous to one another to form the materially integral connection. By coating with an adhesive which is activated at a specific temperature, there is no need for a plurality of coated supporting threads to lie one against the other, but, instead, it is sufficient if a supporting thread coated with adhesive bears against another supporting thread, which may or may not itself be coated with an adhesive, and the knitted spacer fabric is heated to the activation temperature. The two mutually crossing supporting threads then adhere to one another on account of the adhesive action of the adhesive, without a materially integral connection of the two coatings having to take place. Alternatively, the spun-around layer may be formed of a low-melting material which is melted by setting the temperature. A chemical dissolving of the coating, sheathing or spun-around layer, with subsequent curing, may also take place, in order to achieve a connection of the supporting threads.

In order to set the hardness of the knitted spacer fabric, or the resistance offered by the knitted spacer fabric to a pressure or shear force, 20% to 80% of the threads may be coated or provided with an adhesive. Depending on the intended use, it is possible to generate a desired number of connection points between the supporting threads so that, in addition to the crossing angle and the density of the supporting threads, the hardness and the shear strength of the knitted spacer fabric are set as a function of the number of connection points. A supporting thread may also be connected to other supporting threads at a plurality of points. The supporting threads may have different diameters, whether due to coating with a synthetic material or to coating with adhesive, and the desired compressive strength and shear stability may be established by choosing a suitable supporting thread dimensioning.

In a method for producing a knitted spacer fabric according the present invention, at least parts of the mutually crossing supporting threads which connect an upper textile and a lower textile to one another in a spaced manner are connected to one another at their crossing points such as by adhesive bonding or welding to one another.

In embodiments in which the supporting threads have a core which is provided with a coating, sheathing or spun-around layer, the the melting point of the coating, sheathing or spun-around layer is lower than that of the core such that the knitted spacer fabric may be heated to a temperature below the melting point of the core and above the melting point of the coating, sheathing or spun-around layer. As a result, either the adhesive is activated or the coatings of synthetic material are fused, so that a nonpositive or materially integral connection is obtained between two mutually crossing supporting threads. Instead of a thermal bond, a chemical bond may also take place by dissolving and curing the coating, sheathing or spun-around layer.

Alternatively, uncoated supporting threads may be connected to one another by a thermal or chemical bond, in that only part of the supporting thread is melted or dissolved and subsequently cured.

After connecting the supporting threads by heating to a predetermined temperature, the knitted spacer fabric may be maintained at a temperature below the melting or activation temperature, in order to break down deformations and stresses occurring within the knitted spacer fabric.

BRIEF DESCRIPTION OF THE DRAWINGS

An exemplary embodiment of the invention is explained in more detail below with reference to the accompanying figures in which:

FIG. 1 is a schematic view of a conventional knitted spacer fabric; and

FIG. 2 is a schematic view of a knitted spacer fabric according to the invention.

DETAILED DESCRIPTION

In FIG. 1, a prior art knitted spacer fabric 1 with an upper textile 2 and a lower textile 3 is shown. Supporting threads 4 are arranged between textiles 2, 3, which cross one another and are fastened to the textiles 2, 3 in a predetermined weave and density. The supporting threads 4 are not connected to one another, and therefore the compression hardness, e.g., the resistance to loading perpendicularly to the textile plane, is determined by the diameter of the supporting threads 4, the bonding of the supporting threads 4 to the textiles 2, 3, the density of the supporting threads 4 in the finished product and the crossing angle of the supporting threads 4.

To provide a knitted spacer fabric that cannot be pressed together, or can only be pressed together with substantially greater effort, to the knitted spacer 10 fabric shown FIG. 2, includes mutually crossing supporting threads 40 connected to one another at their crossing or connection points 50 either via an adhesive or in a materially integral manner by virtue of a fused connecting coating of the monofilaments used according to embodiments of the present invention. Connecting planes 60, which give rise to an increased stability of the knitted spacer fabric 10, are provided at specific heights of the finished knitted spacer fabric 10 as a function of the density of the supporting threads 40 and of the crossing angle. The connecting planes 60, which are the two planes in the exemplary embodiment illustrated, may be pressed together under load to prevent connection points 50 from coming loose resulting in connecting planes 60 pressing together. In the case of longer supporting threads 40 or a corresponding density and selection of the crossing angles, even more connecting planes 60 may be provided. A fixed number of connection points 50 can be defined by means of a predetermined arrangement density of the supporting threads 40 and their corresponding orientation at an angle to the surface of the textiles 20, 30. It is thus possible to define the weight load at which the knitted spacer fabric 10 can be pressed together fully. An appropriately adapted material can thus be manufactured for various weight classes of a patient or for various loads.

So that not all the crossing points of the supporting threads 40 are connected to one another and become connection points 50, a restricted and predetermined number of supporting threads 40 or monofilaments are provided with a coating and an adhesive. In this manner increased resistance to pressing together or to a shear movement in the knitted spacer fabric 10 can be provided in a uniformly distributed manner. It is likewise possible to provide an increased number of connections at only specific points of a finished knitted spacer fabric 10, and this can be implemented by the arrangement of coated and uncoated supporting threads in specific regions of the knitted spacer fabric 10. It is thus possible to provide load-tailored resistances in a knitted spacer fabric 10, in order to achieve a uniform support of the entire body, for example in decubitus patients.

Due to the increased resistance to pressure load and increased shear stability, thinner products can be utilized for the same loads. New applications are also possible, for example as upholstery material, prosthetics orthotics, or as shoe inserts.

According to one embodiment, to achieve a minimum amount of flexibility and elasticity, not all the crossing points 50 of the supporting threads 40 are connected to one another.

After connection by heating, there is provision for maintaining the finished knitted spacer fabric 10 at an increased temperature below the activation or melting temperature of the coating, so that stresses present within the knitted spacer fabric 10 can be broken down.

The invention claimed is:

1. A knitted spacer fabric comprising:

an upper textile;

a lower textile; and mutually crossing supporting threads arranged between the upper textile and the lower textile which connect the upper and the lower textiles to one another wherein at least parts of a plurality of the supporting threads are connected to one another at crossing points by one of adhesive bonding, chemical dissolving or heat welding and wherein if connected by adhesive bonding or heat welding a plurality of the supporting threads include a coating or sheath disposed over a thread core having a higher melting point than the coating or sheath.

2. The knitted spacer fabric according to claim 1, wherein the supporting threads comprise monofilaments, twisted supporting threads or spun core/sheath assemblies.

3. The knitted spacer fabric according to claim 1, wherein the supporting threads are coated or sheathed.

4. The knitted spacer fabric according to claim 3, wherein the coating or sheathing has a lower melting point than a core of the supporting thread.

5. The knitted spacer fabric according to claim 3, wherein 20% to 80% of the supporting threads are coated.

6. The knitted spacer fabric according to claim 3, wherein the coating comprises a synthetic material or a thermally activatable adhesive.

7. The knitted spacer fabric according to claim 1, wherein the supporting threads have different diameters.

8. The knitted spacer fabric according to claim 1, wherein the supporting threads are connected to one another in a materially integral manner or are adhesively bonded to one another.

9. A method for producing a knitted spacer fabric comprising the steps of connecting an upper textile to a lower textile in a spaced manner by supporting threads, wherein at least parts of a plurality of the supporting threads are connected to one another at their crossing points by one of adhesive bonding and heat welding and wherein the supporting threads include a coating or sheath disposed over a core having a higher melting point than the coating or sheath.

10. The method according to claim 9, wherein the knitted spacer fabric is heated to a temperature below a melting point of the core and above a melting point of the coating to connect the supporting threads.

11. The method according to claim 9, wherein between 20% and 80% of the supporting threads are connected to one another, in order to set a hardness of the knitted spacer fabric.

12. The method according to claim 10, wherein after the supporting threads are connected to one another, the knitted spacer fabric is heated to a temperature below the melting temperature of the coating for a defined period of time.

13. The method according to claim 9, wherein the supporting threads are coated with a thermally activatable adhesive, and wherein the knitted spacer fabric is heated to an activation temperature.

14. A method for producing a knitted spacer fabric comprising:

providing an upper textile and a lower textile;

connecting the upper textile and the lower textile to one another by supporting threads such that the upper textile and the lower textile are spaced apart from one another; and connecting at least parts of the supporting threads to one another by chemically dissolving at least parts of the supporting threads at crossing points.

15. The method according to claim 14, further comprising coating a core of the supporting threads.

16. The method according to claim 15, further comprising heating the knitted spacer fabric to a temperature below a melting point of the core and above a melting point of the coating.

17. The method according to claim 14, further comprising heating the knitted spacer fabric for a defined period of time after the supporting threads are connected to one another.

* * * * *